United States Patent [19]

Roberts

[11] 4,409,521

[45] Oct. 11, 1983

[54] FLUORESCENT LAMP WITH REDUCED ELECTROMAGNETIC INTERFERENCE

[75] Inventor: Victor D. Roberts, Burnt Hills, N.Y.

[73] Assignee: General Electric Company, Schenectady, N.Y.

[21] Appl. No.: 277,422

[22] Filed: Jun. 25, 1981

Related U.S. Application Data

[63] Continuation of Ser. No. 104,422, Dec. 17, 1979, abandoned.

[51] Int. Cl.[3] ..... H01J 7/44; H01J 17/34; H01J 19/78; H01J 29/96

[52] U.S. Cl. ..... 315/57; 307/89; 307/91; 313/493; 313/161; 315/8; 315/85; 315/70; 315/278

[58] Field of Search ..... 313/493, 153, 161; 307/89, 90, 91; 315/8, 85, 56, 57, 58, 59, 60, 62, 70, 278

[56] References Cited

U.S. PATENT DOCUMENTS

| | | | |
|---|---|---|---|
| 2,930,920 | 3/1960 | Bird | 315/85 X |
| 3,079,521 | 2/1963 | Clark | 313/493 |
| 4,245,179 | 1/1981 | Buhrer | 315/85 |
| 4,254,363 | 3/1981 | Walsh | 315/85 |

*Primary Examiner*—Saxfield Chatmon, Jr.
*Attorney, Agent, or Firm*—William H. Steinberg; James C. Davis, Jr.; Marvin Snyder

[57] ABSTRACT

The electromagnetic interference produced by arc discharge lamps and other devices operating at frequencies in excess of 15,000 Hz is reduced by providing a current path external to the envelope containing the discharge, the current flow in the path being oriented so as to produce a magnetic field generally in opposition to the magnetic field generated by the current in the arc discharge. The present invention is particularly applicable to circular fluorescent lamps with a centrally disposed ballast operating at relatively high frequencies.

16 Claims, 9 Drawing Figures

Fig. 1
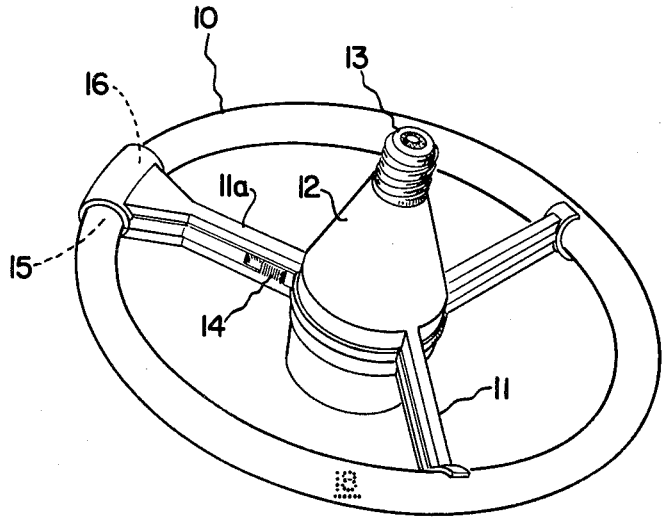
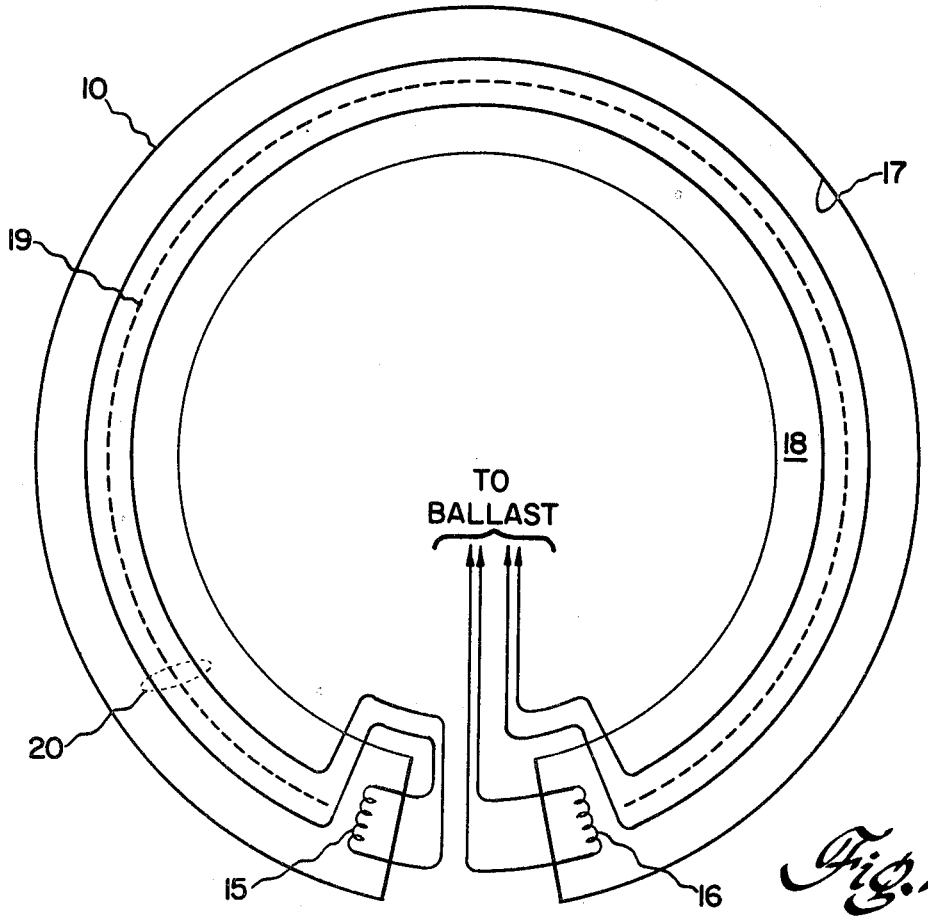
Fig. 2

FLUORESCENT LAMP WITH REDUCED ELECTROMAGNETIC INTERFERENCE

This application is a continuation of application Ser. No. 104,422, filed Dec. 17, 1979, now abandoned.

BACKGROUND OF THE INVENTION

This invention relates to arc discharge lamps such as fluorescent lamps which operate at relatively high frequencies and in particular the present invention relates to circular fluorescent lamps having a centrally disposed ballast.

Because of the significant economic desire to conserve electrical energy, it has become increasingly desirable at the present time to increase the efficiency of electrical lighting systems. In particular, it is desirable to replace, to the extent possible, incandescent bulbs operating at efficacies of only approximately 15 lumens per watt with more efficient fluorescent lamp devices. Present fluorescent lamp devices operate at efficacies of approximately 40 lumens per watt or more. However, because of the nature of the arc discharge, special power supply problems exist for fluorescent lamps. The power supply circuits for such lamps are generally referred to in the art as ballasts. These ballasts, which are common in the fluorescent lamp arts, generally provide different power levels to the lamp because of the differences in lamp characteristics during startup and during the normal operation. In certain fluorescent lamps, the startup may be facilitated by the employment of filaments heated by a separate circuit in the ballast. Such lamps employ two conductors between each end of the lamp and the ballast. These are known as rapid start lamps. In other lamps, a single current supply is first used to heat the filaments and is then switched to power the discharge. The switching action is caused by a manually operated switch or an automatic, glow discharge, thermal switch, known as a starter. Such lamps employ one conductor between each end of the lamp and the ballast, and one conductor between each end of the lamp and the starting switch. These are known as switch start lamps. In a third type of lamp, starting is accomplished by providing a high voltage to initiate the discharge between electrodes disposed at either end of the lamp. Such lamps employ one conductor between each end of the lamp and the ballast. These are known as instant start lamps.

It has recently been determined that the weight and material requirements of the ballast can be significantly reduced if the lamp is operated at frequencies above 15,000 Hz. Such operation has also been found to promote increased lamp efficacy. However, it is also known that lamps operating at such high frequencies, that is, frequencies in excess of 15,000 Hz, can produce electromagnetic interference potentially capable of disturbing radio and television reception. If the fundamental frequency of an electronic inverting ballast lies below the AM broadcast band (535 kHz to 1,605 kHz), the most serious interference problem is caused by the magnetic field radiated by the lamp/ballast system. The electric field is less of an interference problem since AM radio receivers generally used in the home are designed to respond to the magnetic field component of an electromagnetic wave and are relatively insensitive to the electric field component. Magnetic field radiation is produced by electric currents flowing in conductors, and in particular for the applications intended here, magnetic field radiation is produced by the current flowing in the discharge lamp itself. The intensity of the radiated magnetic field is proportional to the current flowing in the circuit multiplied by the area of the current loop. This quantity is generally referred to as the magnetic moment.

The radiation of magnetic field interference is generally controlled in several ways. For example, a conductive shield could be placed around the offending current loop. Thus, it is easy to control electromagnetic interference emanating from the ballast itself simply by employing a conductive shield. However, it is significantly more difficult to provide proper shielding for the lamp itself because it is desirable to employ a material which possesses not only high electrical conductivity but also high light transmissivity. Another means of controlling electromagnetic interference is to filter the ballast output waveform to eliminate frequency components in the AM frequency band. While the fundamental frequency of most electronic ballasts is below 535 kHz, nonetheless, interference is caused by harmonics of the fundamental frequency which are generated by the ballast or lamp and radiated by the current loop within the lamp envelope. Moreover, it is generally true that high efficiency inverters generate output waveforms which include these undesirable harmonics. These interference producing harmonics may be filtered out of the ballast waveform before it is applied to the lamp, but such filters usually dissipate power, are physically large, and expensive.

SUMMARY OF THE INVENTION

In accordance with a preferred embodiment of the present invention, an arc discharge device comprises an elongated evacuable envelope with electrodes disposed at either end and containing an ionizable discharge medium. The discharge device operates by alternatingly conducting current between the electrodes in opposite directions. The present invention provides electromagnetic radiation reduction means external to the lamp envelope which comprises a conductive current path in which the direction of the current flow is generally opposite to the direction of current flow of the discharge within the envelope so as to produce a magnetic field in opposition to the magnetic field produced by the discharge. The present invention is particularly applicable to fluorescent discharge lamps where the discharge arc describes a path which almost closes on itself, such as in the Circline® fluorescent lamp. The cancellation field is generated by a current loop preferably lying in the same plane as the lamp and constructed such that the cancellation magnetic field is 180° out of phase with the magnetic field generated by the discharge. The cancellation loop has substantially the same magnetic moment as the discharge current loop so as to effect the greatest degree of interference cancellation. While the present invention is most applicable to circular fluorescent lamps, it is also applicable to the more common linear fluorescent lamps and also to other arc discharge devices operating at frequencies in excess of approximately 15,000 Hz.

Accordingly, it is an object of the present invention to provide an efficient fluorescent light source operating at a relatively high frequency with significantly reduced levels of electromagnetic interference.

DESCRIPTION OF THE DRAWINGS

FIG. 1 is a perspective view illustrating a circular fluorescent lamp with a centrally disposed ballast adapted for insertion into a conventional incandescent lamp socket.

FIG. 2 is a schematic diagram illustrating one embodiment of the present invention in which the current canceling loop is disposed along the lamp envelope.

DETAILED DESCRIPTION OF THE INVENTION

Figure 3:
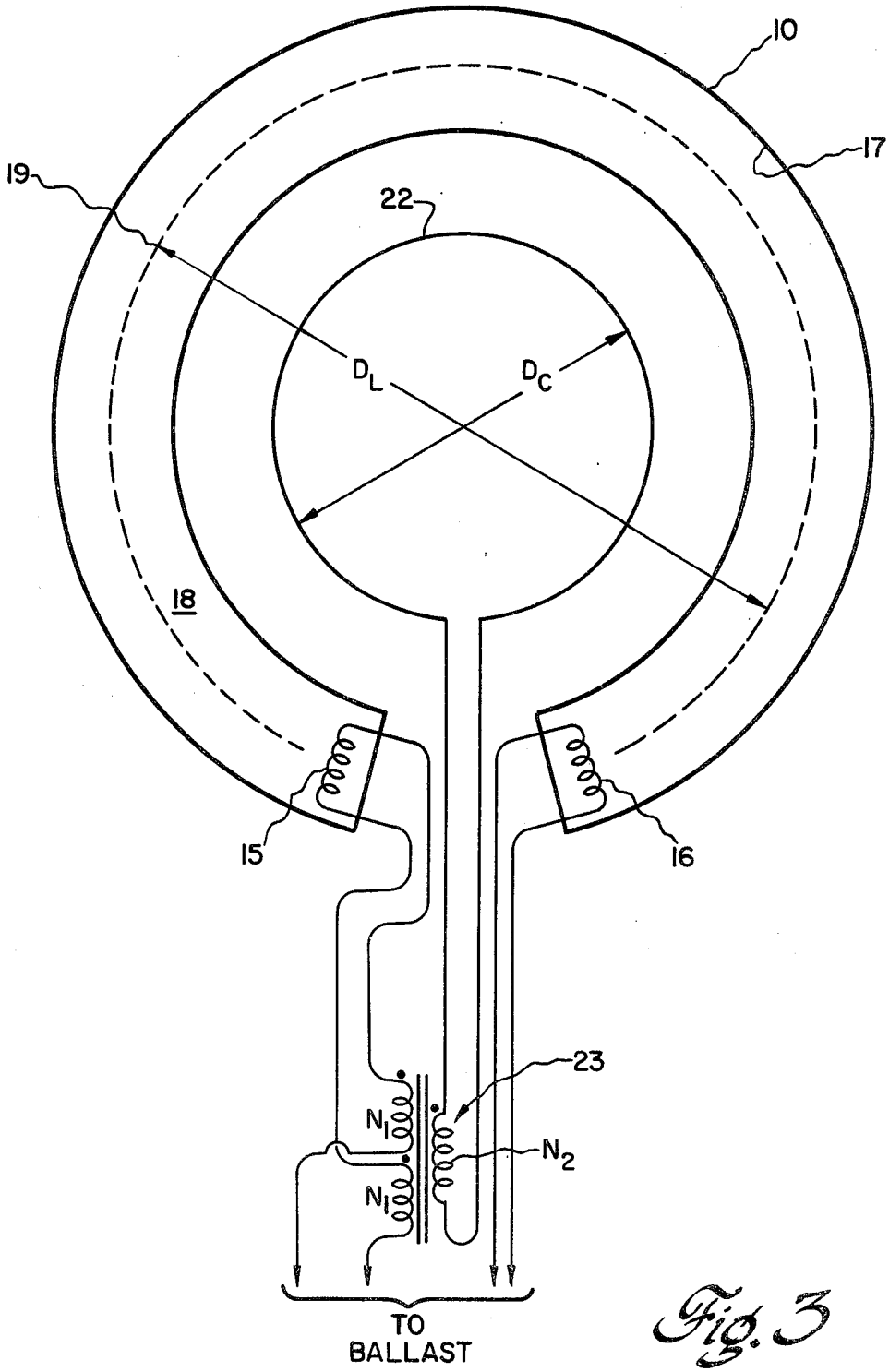
FIG. 3 is a schematic diagram illustrating another embodiment of the present invention in which the cancellation loop has a smaller diameter than the discharge current loop, said size difference being compensated by a current transformer.

FIG. 1 illustrates a fluorescent lamp of the kind for which the present invention is particularly applicable. In this lamp, the ionizable discharge medium 18, such as mercury vapor and a noble gas such as argon is contained within the discharge envelope 10 which comprises glass coated with an ultraviolet excitable phospor. Within the envelope and at either ends thereof are electrodes 15 and 16 (not shown) between which the discharge current flows. The lamp envelope 10 is supported by spider legs 11 which are preferably composed of a light weight plastic material which is somewhat heat resistant. The spider legs 11 are attached to a central hub containing therein a ballast 12 which may be removable by actuation of slide switch 14. The slide switch 14 is disposed in spider leg 11*a* which contains the electrical leads connecting the ballast 12 with the lamp electrodes 15 and 16. The ballast also possesses a conventional screw-in base 13 for insertion into a conventional incandescent lamp receptacle. Thus, the ballast functions to convert 60 cycle alternating current or currents at other frequencies to alternating current at a frequency in excess of 15,000 Hz for supplying power to the lamp itself. The alternating current discharge through ionizing medium 18 generally operates to produce ultraviolet radiation which impinges upon phosphor 17 (shown in FIG. 2) which internally coats the envelope wall. It is the excitation of this phosphor which results in visible wavelength illumination.

FIG. 2 illustrates one embodiment of the present invention in which a cancellation loop is disposed exterior to the lamp. There is also shown in FIG. 2 the mean arc discharge path 19 shown as a dotted line. In this embodiment, the diameter of the cancellation coil is chosen so as to be substantially equal to the diameter of the discharge path. The leads connected to filament 15 are disposed along the exterior surface of the discharge envelope 10. During normal running of the discharge lamp, the current in cancellation loop 20 flows in a direction generally opposite to that of the current in the discharge path. This opposing current produces a magnetic moment substantially the same as, but oppositely directed, to the magnetic moment produced by the current in the discharge envelope 10. In this fashion, the electromagnetic interference generated by the high frequency operation of the lamp is significantly reduced.

FIG. 2 illustrates a rapid start lamp where two conductors from each end of the lamp are connected to the ballast. Since a portion of the discharge current flowing to or from one end of the lamp flows through one of the conductors attached to that end of the lamp while the remainder of the discharge current to that end of the lamp flows through the other conductor attached to that same end of the lamp, the cancellation loop is formed by both leads from one end of the lamp as a pair. This pair of conductors constitutes a single turn cancellation loop. If instant start or switch start lamps are used, the cancellation loop is formed by one of the single conductors connected between the ballast and one end of the lamp. An embodiment of the present invention employed in a switch start lamp is described below in reference to FIG. 7.

The conductive cancellation loop leads themselves may be provided in one of several ways. For example, a conductive coating on the glass itself may be provided, particularly, if the coating has a sufficiently low electrical resistance. It is also desirable that the electrical coating be transulucent. For example, tin oxide or alloys of indium and tin oxide may be employable under certain lamp operating conditions. Alternatively, the leads may be provided by a conductive tape adhesively attached to the envelope wall.

The leads which form the cancellation loop may be spiraled around the lamp envelope itself. If conductive coatings are employed, wide coatings which cover a substantial portion of the glass surface will provide more effective cancellation than narrow coatings. If conductive coatings are used with switch start or instant start lamps which require only a single conductor cancellation loop, the preferred embodiment is a conductive coating which covers substantially the entire lamp surface. This will cause the cancellation magnetic field to most closely match the lamp magnetic field.

The cancellation conductors 20 typically carry approximately 0.6 amperes of current during normal operation. Insulation of these conductors is preferred to reduce shock hazards.

Also noted in FIG. 2 is that conductive leads from filaments 15 and 16 are directed toward the center of the lamp to a ballast hub thereof such as shown in FIG. 1. In particular, the leads to the ballast would be conducted along spider leg 11*a* in FIG. 1. However, the present invention is also employable with ballast located at positions other than the center of the lamp.

FIG. 3 illustrates another embodiment of the present invention in which the cancellation loop possesses a diameter $D_C$ which is less than the diameter of the arc discharge path $D_L$. However, as can be seen from the definition of magnetic moment given above, cancellation does not automatically occur in this embodiment because of the difference in loop path areas. However, cancellation loop 22 is coupled through current transformer 23 with windings as shown. The turns ratio of the primary windings and the secondary winding are adjusted in accordance with the following formula $$\frac{N_1}{N_2} = \frac{D_L^2}{D_C^2} \quad (1)$$

As long as the turns ratio shown in FIG. 3 is selected in accordance with the above formula, cancellation of the magnetic moment is accomplished. In particular, it is desirable in the present invention to design the value of $D_C$ so that the cancellation current loop is wholly contained within the ballast hub 10 which would also contain the current transformer 23. However, for clarity, this physical positioning of the components is not shown since FIG. 3 is essentially a schematic diagram. Alternatively, $D_C$ may be chosen so as to position the cancellation loop along the inside diameter of the discharge envelope 10, in which case it can be made to function also as the starting aid (ground plane) necessary for effective discharge initiation in rapid start lamps. Not only does the current transformer compensate for the relatively small difference in current loop areas in accordance with Formula 1, but it also provides electrical isolation between the cancellation loop and the lamp electrodes which permits the cancellation loop to be connected to circuit common or a voltage source within the ballast designed to apply a relatively high potential between the cancellation loop and the electrodes 15 and 16. The application of this potential does not affect the current flow through the loop and therefore does not change the magnetic field produced by the cancellation loop. If instant start or switch start lamps are used, the current transformer will have only a single primary winding connected to the single conductor from one end of the lamp. The present invention is also employable with cancellation loops which possess a diameter, DC, which is greater than the diameter of the discharge path. The turns ratio of the primary windings and secondary windings of the current transformer 23 are again adjusted in accordance with the aid of Formula 1, above.

Figure 4:
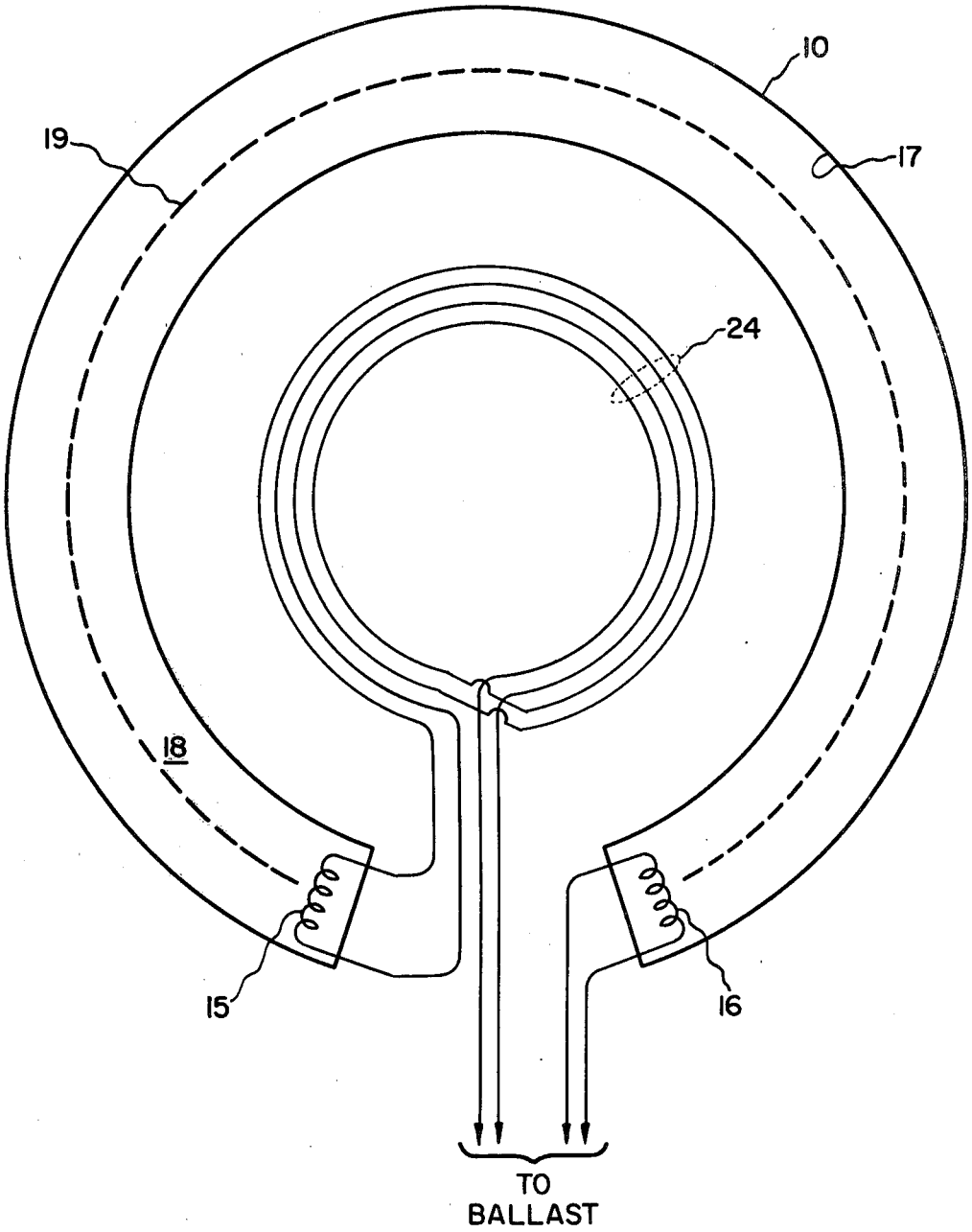
FIG. 4 is a schematic diagram illustrating another embodiment of the present invention in which the difference in current loop diameters is compensated for by an increase in the number of turns in the cancellation loop.

FIG. 4 shows another embodiment of the present invention in which the cancellation loop diameter is smaller than the discharge loop diameter, that is, $D_C$ is less than $D_L$. However, by providing an increased number of turns in the cancellation loop, cancellation of the magnetic moments is readily achieved. In particular, in the embodiment of FIG. 4, to achieve substantially optimal cancellation, the significant design parameters are related as follows:

$$D_C = D_L/\sqrt{N}, \quad (2)$$

where N is the number of turns in the cancellation loop. In particular Fig. 4 illustrates the case for N equals 2. When rapid start lamps are used, each of the two conductors connected to a particular filament carries a portion of the discharge current. The conductors are therefore taken in unison, as a pair, when constructing the cancellation loop. The number of turns, N, in Formula 2 above, is determined, in this case, by counting the number of turns of conductor pairs.

Figure 5:
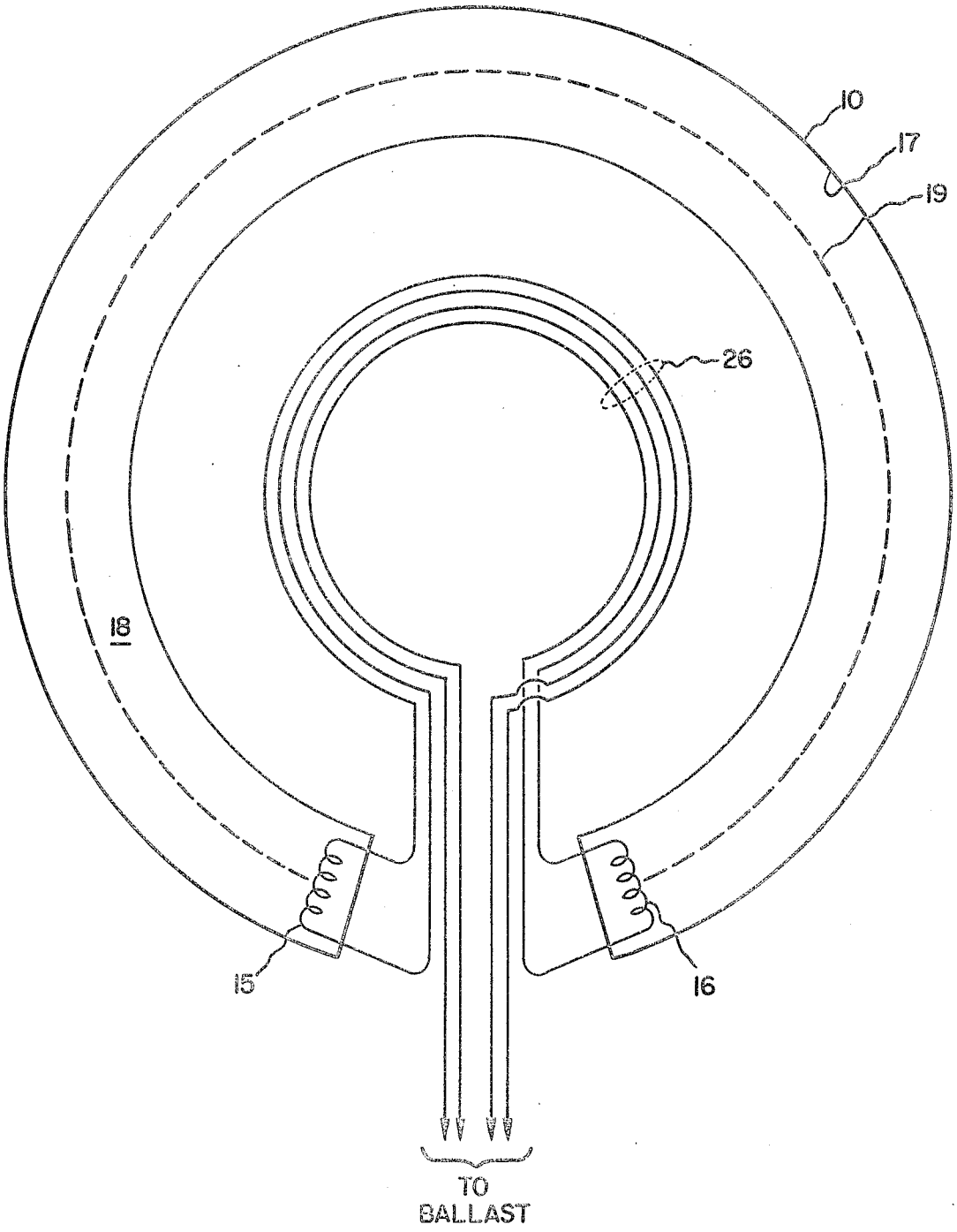
FIG. 5 is a schematic diagram similar to FIG. 4 in which there is a cancellation loop associated with each filament.

FIG. 5 illustrates an embodiment of the present invention which is identical to that shown in FIG. 4 except that in this embodiment a cancellation current loop is provided in each of the circuits for electrodes 15 and 16. Equation 2 is also applicable to the embodimemt of FIG. 5, which also illustrates the case for N equals 2.

Figure 6:
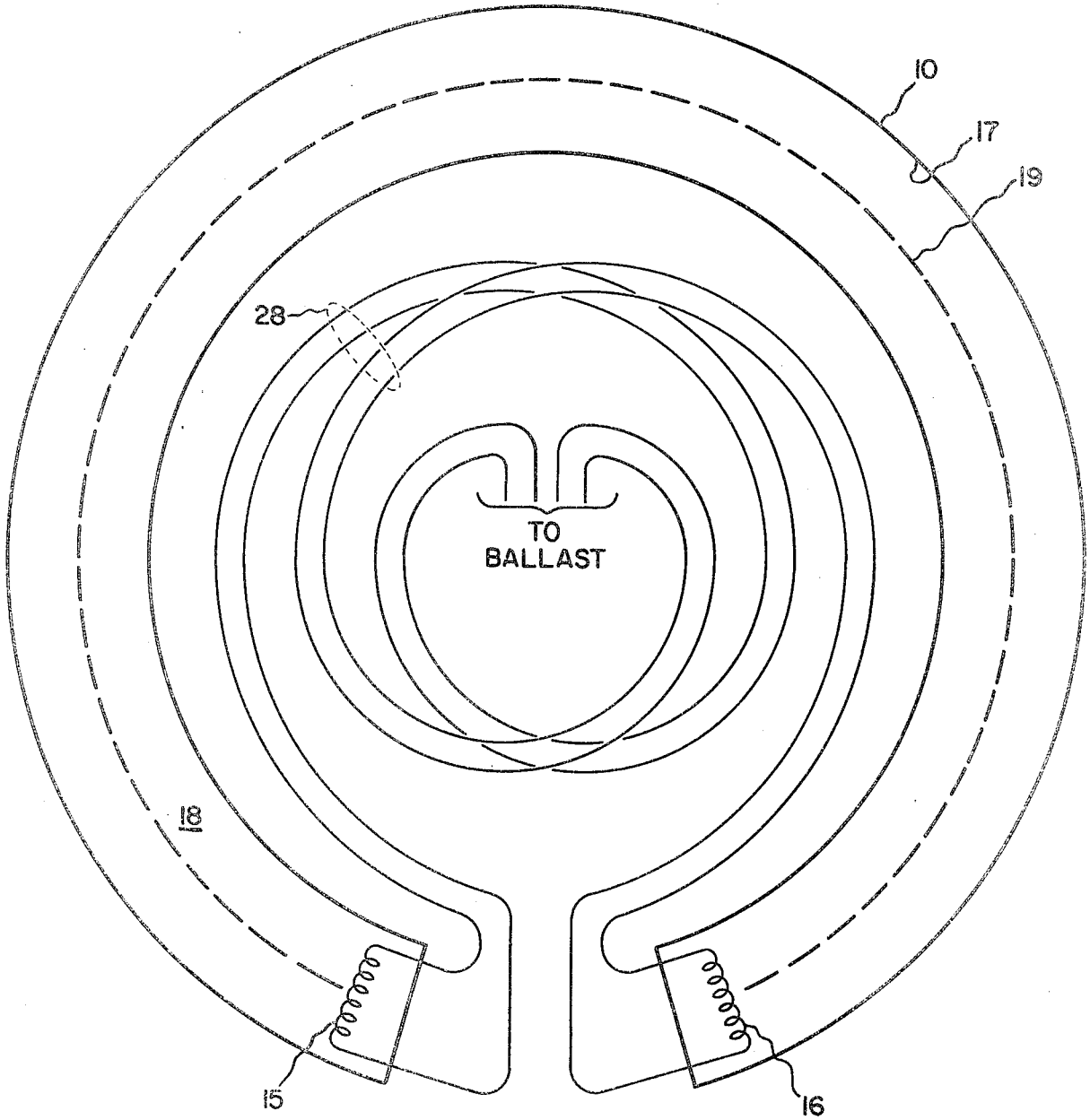
FIG. 6 is a schematic diagram of the present invention in which the cancellation loop comprises a multiturn spiral.

While the invention is preferably practiced by the use of circular current loops to effect a cancellation of the magnetic fields produced by the discharge current, other cancellation loop patterns may also be employed to effect the same purposes. In particular, FIG. 6 shows a symmetric spiral pattern of cancellation loop conductors 28 which also operates to effectively reduce the electromagnetic interference.

Figure 7:
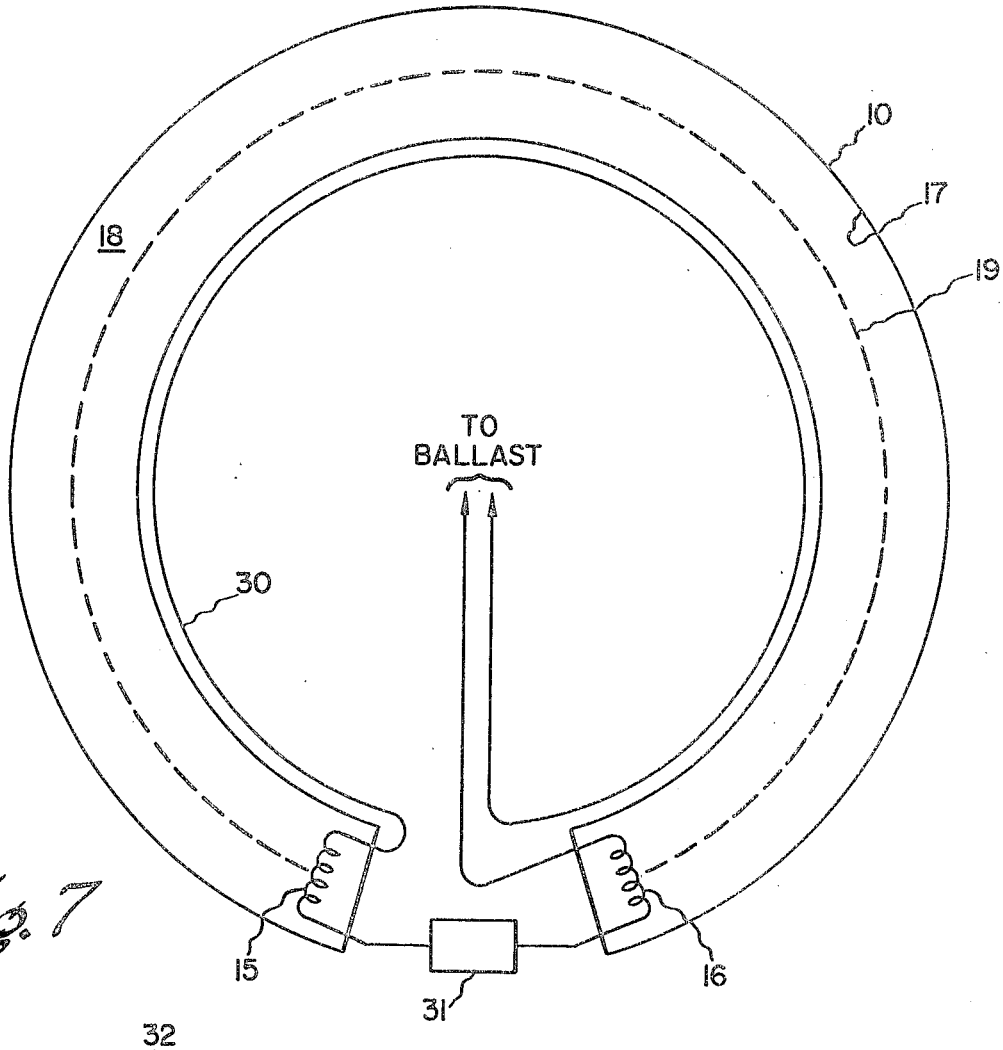
FIG. 7 illustrates an embodiment of the present invention in which a starter switch is employed in series with the lamp filaments.

FIG. 7 illustrates another emobdiment of the present invention in which a switch start fluorescent lamp is employed. The starter 31 is connected between filaments 15 and 16. In this particular embodiment, a single cancellation loop lead 30 is employed. FIG. 7 also illustrates the fact that a significant amount of electromagnetic interference is eliminated even by disposing the cancellation loop along an inside diameter of the discharge envelope. Although magnetic moment cancellation is not exact, a desirable level of illumination results with minimal obstruction.

Figure 8:
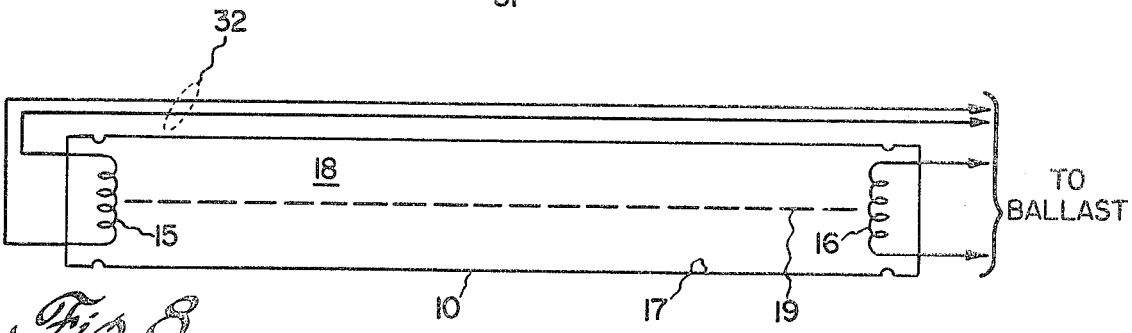
FIG. 8 is a schematic diagram illustrating an embodiment of the present invention employable with linear fluorescent lamps.
Figure 9:
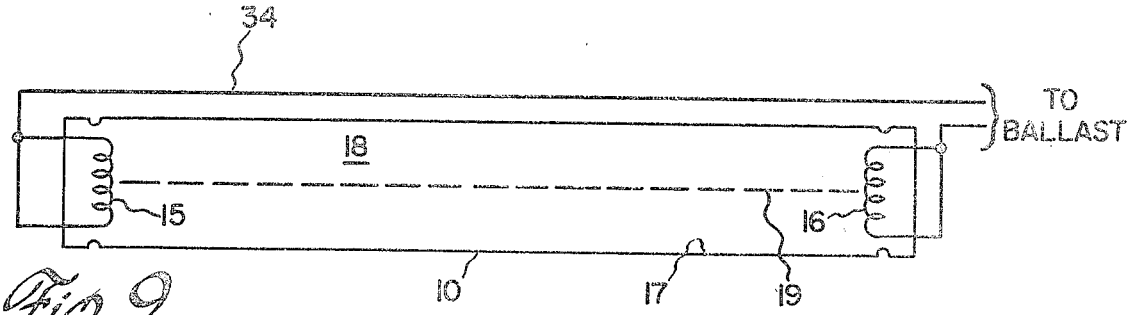
FIG. 9 is a schematic diagram illustrating one embodiment of the present inventionemployable with a linear fluorescent lamp started by high voltage.

FIGS. 8 and 9 illustrate the employment of cancellation current conductors 32 and 34 of the present invention in the more conventional linear fluorescent lamp structures. The basic difference between the embodiment shown in FIGS. 8 and 9 is that the lamp in FIG. 8 is a rapid start lamp and the lamp in FIG. 9 is an instant start lamp. In these embodiments, the cancellation conductors may be spiraled around the lamp and may be composed of conductive coating as described in reference to FIG. 2.

For the embodiments of the present invention shown in FIGS. 2 and 7, it is preferable that the cancellation loop conductors 20 and 30, respectively, be fixed to the discharge envelope 10. For those embodiments shown in FIGS. 4 and 5, it is preferred that cancellation loops 24 and 26, respectively, be chosen to be of sufficient diameter as to be contained wholly or at least substantially within the ballast hub 10. However, these conductors may also be disposed within a separate concentric circular insulated housing supported by spider legs 11.

From the above, it may be appreciated that the present invention permits efficient operation of fluorescent lamp structures at relatively high frequency alternating currents without the concomitant problem of electromagnetic radiation interference. The objects of the present invention are accomplished with minimal design change and are readily manufacturable.

While the invention has been described with reference to particular embodiments and examples, other modifications and variations will occur to those skilled in the art in view of the above teachings. Accordingly, it should be understood that within the scope of the appended claims, the invention may be practiced otherwise than is specifically described.

The invention claimed is:

1. An arc discharge device comprising:

an elongate evacuable envelope having electrodes disposed within said envelope at opposite ends thereof, said envelope containing an ionizable discharge medium, said discharge device operating by the conduction of alternating current between said electrodes through said medium; and electromagnetic radiation reduction means external to said envelope, said means providing a conductive current path in which the direction of current flow is opposite to the direction of current flow within said envelope so as to produce a magnetic field which generally opposes the magnetic field produced by the discharge current flow between said electrodes.

2. The arc discharge device of claim 1 in which said alternating current flow occurs at a frequency in excess of 15,000 Hz.

3. The arc discharge device of claim 1 in which said envelope is generally circular.

4. The arc discharge device of claim 1 in which said device is a fluorescent lamp.

5. The arc discharge device of claim 1 in which said device is a circular fluorescent lamp.

6. The arc discharge device of claim 5 in which a ballast is disposed at the center of said circular lamp.

7. The arc discharge device of claim 5 in which said electrodes comprise filaments.

8. The arc discharge device of claim 7 in which said electromagnetic radiation reduction means comprises a pair of conductive leads extending from one of said filaments along the outside of said envelope substantially parallel to the current path within said envelope.

9. The arc discharge device of claim 7 in which said electromagnetic radiation reduction means comprises a conductive loop having a diameter smaller or larger than the diameter of the arc discharge path and disposed within the plane of said discharge current path, said means being matched to cancel the magnetic moment produced by said discharge current, by means of a current transformer having a selected turns ratio.

10. The arc discharge device of claim 7 in which said electromagnetic radiation reduction means comprises a conductive loop having a diameter less than the diameter of the discharge current path and having a plurality of turns.

11. The arc discharge device of claim 10 in which the conductive loop is electrically connected directly to only one electrode.

12. The arc discharge device of claim 10 in which a conductive current loop is provided in each electrode circuit.

13. The arc discharge device of claim 7 in which the electromagnetic radiation reduction means comprises a symmetric spiral disposed within the plane of said arc discharge path.

14. The arc discharge device of claim 7 in which said filaments are connected in series with a starter switch and in series with a ballast power supply with one electrical conductor from said supply being disposed along the arc discharge path.

15. The arc discharge device of claim 7 further including a ballast disposed at the center of said lamp.

16. The arc discharge device of claim 1 in which said electromagnetic radiation reduction means comprises an electrically conductive coating disposed on said envelope.

* * * * *